US009675983B2

(12) United States Patent
Charpie et al.

(10) Patent No.: US 9,675,983 B2
(45) **Date of Patent: *Jun. 13, 2017**

(54) FLUID THROUGH NEEDLE FOR APPLYING MULTIPLE COMPONENT MATERIAL

(71) Applicant: Carlisle Fluid Technologies, Inc., Charlotte, NC (US)

(72) Inventors: Mark E. Charpie, Ottawa Lake, MI (US); Marvin D. Burns, Millbury, OH (US)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 200 days.

This patent is subject to a terminal disclaimer.

(21) Appl. No.: 14/462,206

(22) Filed: Aug. 18, 2014

(65) Prior Publication Data

US 2014/0353395 A1 Dec. 4, 2014

Related U.S. Application Data

(63) Continuation of application No. 12/765,699, filed on Apr. 22, 2010, now Pat. No. 8,807,460.

(Continued)

(51) Int. Cl.
*B05B 7/02* (2006.01)
*B05B 7/24* (2006.01)

(Continued)

(52) U.S. Cl.
CPC ..... *B05B 7/2478* (2013.01); *B05B 1/32* (2013.01); *B05B 7/025* (2013.01); *B05B 7/061* (2013.01);

(Continued)

(58) Field of Classification Search
CPC ..... B05B 7/2478; B05B 1/32; B05B 7/025; B05B 7/061; B05B 7/12; B05B 7/2408;

(Continued)

(56) References Cited

U.S. PATENT DOCUMENTS 1,958,730 A 5/1934 Tracy
2,054,136 A * 9/1936 Pfaff ..... B05B 7/12 239/526

(Continued)

FOREIGN PATENT DOCUMENTS

CN 1062102 A 6/1992
CN 2411843 Y 12/2000

(Continued)

OTHER PUBLICATIONS

AU Examination Report No. 1; Application No. 2015200691; Dated Nov. 5, 2015; 3 pgs.

(Continued)

*Primary Examiner* — Steven J Ganey
(74) *Attorney, Agent, or Firm* — Fletcher Yoder, P.C.

(57) ABSTRACT

Embodiments of a spray gun incorporating a needle for applying multiple component materials are provided. In accordance with certain embodiments, the spray gun includes a fluid delivery tip assembly comprising an inner passage, a hollow needle disposed within the inner passage of the fluid delivery tip assembly, wherein the hollow needle comprises at least two indentions along an outer circumferential surface of the hollow needle near an end of the hollow needle, a first passage configured to deliver a first spray fluid to a fluid tip exit of the fluid delivery tip assembly, wherein the first passage is defined by a volume between the fluid delivery tip assembly and the hollow needle, and a second passage through the hollow needle, wherein the second passage is configured to deliver a second spray fluid to the fluid tip exit of the fluid delivery tip assembly.

19 Claims, 7 Drawing Sheets

Related U.S. Application Data

(60) Provisional application No. 61/173,595, filed on Apr. 28, 2009, provisional application No. 61/228,149, filed on Jul. 23, 2009.

(51) Int. Cl.
*B05B 1/32* (2006.01)
*B05B 7/06* (2006.01)
*B05B 7/12* (2006.01)

(52) U.S. Cl.
CPC ..... *B05B 7/12* (2013.01); *B05B 7/241* (2013.01); *B05B 7/247* (2013.01); *B05B 7/2408* (2013.01); *B05B 7/2472* (2013.01); *B05B 7/2494* (2013.01); *B05B 7/2497* (2013.01)

(58) Field of Classification Search
CPC ..... B05B 7/241; B05B 7/247; B05B 7/2472; B05B 7/2494; B05B 7/2497
USPC ..... 239/401, 423, 424, 303–305, 345, 407, 239/409, 416.5, 417.5, 290, 296, 525, 526
See application file for complete search history.

(56) References Cited

U.S. PATENT DOCUMENTS

| | | | | |
|---|---|---|---|---|
| 2,497,625 | A * | 2/1950 | Norwick | B05B 7/065 239/526 |
| 3,027,096 | A | 3/1962 | Giordano | |
| 3,589,607 | A * | 6/1971 | Wolf | B05B 5/03 239/416 |
| 4,496,081 | A | 1/1985 | Farrey | |
| 4,667,878 | A | 5/1987 | Behr | |
| 4,927,079 | A | 5/1990 | Smith | |
| 4,955,544 | A | 9/1990 | Kopp | |
| 5,052,623 | A | 10/1991 | Nordeen | |
| 5,303,865 | A | 4/1994 | Bert | |
| 5,400,971 | A | 3/1995 | Maugans et al. | |
| 5,906,318 | A | 5/1999 | Gurko, III et al. | |
| 5,941,420 | A | 8/1999 | Connan | |
| 7,090,072 | B1 | 8/2006 | Elliott | |
| 8,807,460 | B2 * | 8/2014 | Charpie | B05B 1/32 239/296 |
| 2010/0098870 | A1 | 4/2010 | Staunton et al. | |

FOREIGN PATENT DOCUMENTS

| | | | |
|---|---|---|---|
| EP | 0063707 | A1 | 11/1982 |
| EP | 0132457 | B1 | 11/1989 |
| ES | 2243122 | A1 | 11/2005 |
| FR | 931828 | A | 3/1948 |
| GB | 191223826 | A | 6/1913 |
| GB | 965508 | A | 7/1964 |
| GB | 1406607 | A | 9/1975 |
| GB | 1593718 | A | 7/1981 |
| GB | 2159490 | A | 12/1985 |
| GB | 2293157 | A | 3/1996 |
| IT | 1115909 | B | 2/1986 |
| WO | 03/093130 | A1 | 11/2003 |
| WO | 2006/102472 | A1 | 9/2006 |

OTHER PUBLICATIONS

AU Examination Report No. 1; Application No. 2015200692; Dated Nov. 5, 2015; 4 pgs.
AU Patent Examination Report No. 2; Application No. AU 2015200692; Dated Mar. 7, 2016; 6 pages.
CN First Office Action; Application No. CN201510311908.9; Dated Dec. 1, 2016; 9 pages.

* cited by examiner

FLUID THROUGH NEEDLE FOR APPLYING MULTIPLE COMPONENT MATERIAL

CROSS REFERENCE TO RELATED APPLICATIONS

This application is a continuation of U.S. patent application Ser. No. 12/765,699, entitled "Fluid Through Needle For Applying Multiple Component Material", filed Apr. 22, 2010, which claims priority from and the benefit of and incorporates by reference, each of the following: (a) U.S. Provisional Application Ser. No. 61/173,595, entitled FLUID THROUGH NEEDLE FOR APPLYING MULTIPLE COMPONENT MATERIAL, filed Apr. 28, 2009; and (b) U.S. Provisional Application Ser. No. 61/228,149, entitled FLUID DELIVERY SYSTEM FOR SPRAYING MULTIPLE COMPONENT MATERIAL, filed Jul. 23, 2009.

BACKGROUND

The present invention relates generally to spray coating devices and, more particularly, to a spray gun incorporating a needle for applying multiple component material.

When multiple component coatings (e.g., paints) are used, they are typically mixed by a painter before the painter is ready to spray. Once the painter mixes the component materials together, a chemical reaction is started, and the painter has a limited time to apply the mixed material. Any left over material that the painter may have is then disposed of after the job. The cost of the wasted material may be significant. The spray apparatus must also be cleaned shortly after spraying to prevent the component materials from curing inside the spray apparatus, and also because the component materials may not be suitable for the next paint job because of the particular chemical reaction between the component materials.

BRIEF DESCRIPTION

Embodiments of a spray gun incorporating a needle for applying multiple component materials are provided. In accordance with certain embodiments, the spray gun includes a fluid delivery tip assembly comprising an inner passage, a hollow needle disposed within the inner passage of the fluid delivery tip assembly, wherein the hollow needle comprises at least two indentions along an outer circumferential surface of the hollow needle near an end of the hollow needle, a first passage configured to deliver a first spray fluid to a fluid tip exit of the fluid delivery tip assembly, wherein the first passage is defined by a volume between the fluid delivery tip assembly and the hollow needle, and a second passage through the hollow needle, wherein the second passage is configured to deliver a second spray fluid to the fluid tip exit of the fluid delivery tip assembly.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The current automotive refinishing market is dominated by gravity feed spray guns that have a coating material reservoir mounted on top of the spray gun. When the trigger of the spray gun is pulled, an air valve opens allowing atomization air and pattern shaping air to flow to the air cap. As the trigger is pulled further back, the fluid needle unseats from the fluid tip allowing the material to flow from the reservoir to the fluid tip. The material then exits the fluid tip, where it is atomized and the atomized particles are shaped into a spray pattern. However, as described above, when using this type of spray gun, the user of the spray gun may only have a limited amount of time to apply the material after mixing. In addition, this type of spray gun may lead to waste of unused mixed material left over from the spraying. In addition, the spray gun must be cleaned to prevent curing inside the spray gun. One solution is to use a pressure feed, two-component mixing system, but this type of system may be prohibitively costly and may consist of a cumbersome three-hose bundle to deliver the compressed air, the first component material, and the second component material.

As discussed further below, various embodiments of a spray gun incorporating a needle for applying multiple component material are provided. In accordance with certain embodiments, a first component material may be delivered to the fluid tip of the spray gun from a first component material chamber defined between an inner passage of the fluid delivery tip assembly and the fluid needle of the spray gun. At the same time, a second component material may be delivered to the fluid tip of the spray gun through a hollow center of the fluid needle. As such, the first and second component materials may be mixed at or near the fluid tip of the spray gun, instead of being premixed prior to spraying. By not premixing the first and second component materials, several shortcomings of conventional spraying techniques may be addressed. For example, excess waste materials may be reduced because the first and second component materials are only mixed upon spraying. In addition, because mixing generally occurs in front of the fluid tip exit of the spray gun, cleaning of the spray gun may be required less frequently and may be less time consuming.

Figure 1:
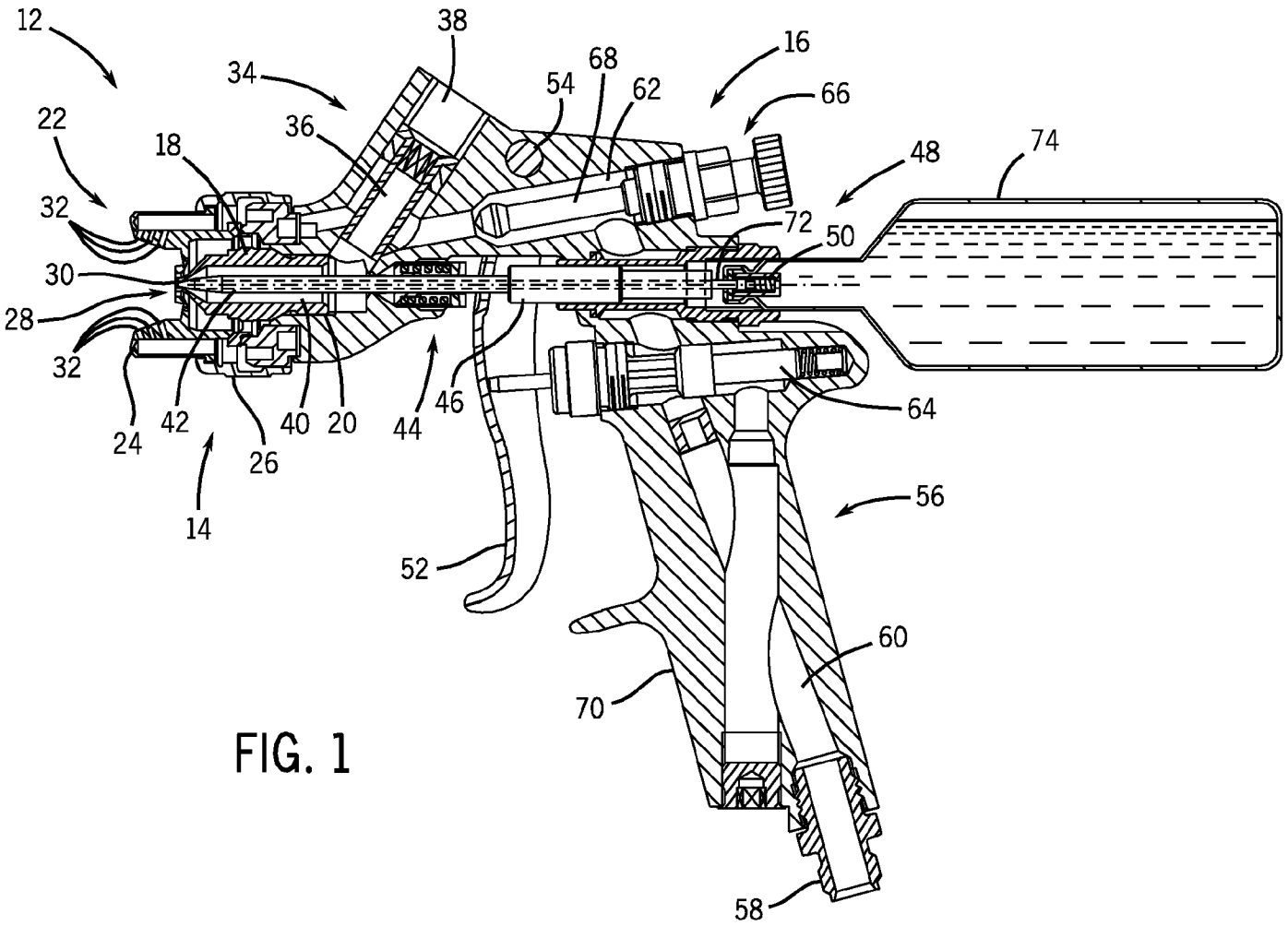
FIGS. 1 and 2 are cross-sectional side views of an exemplary embodiment of a spray coating gun employing a needle for applying multiple component materials.
Figure 2:
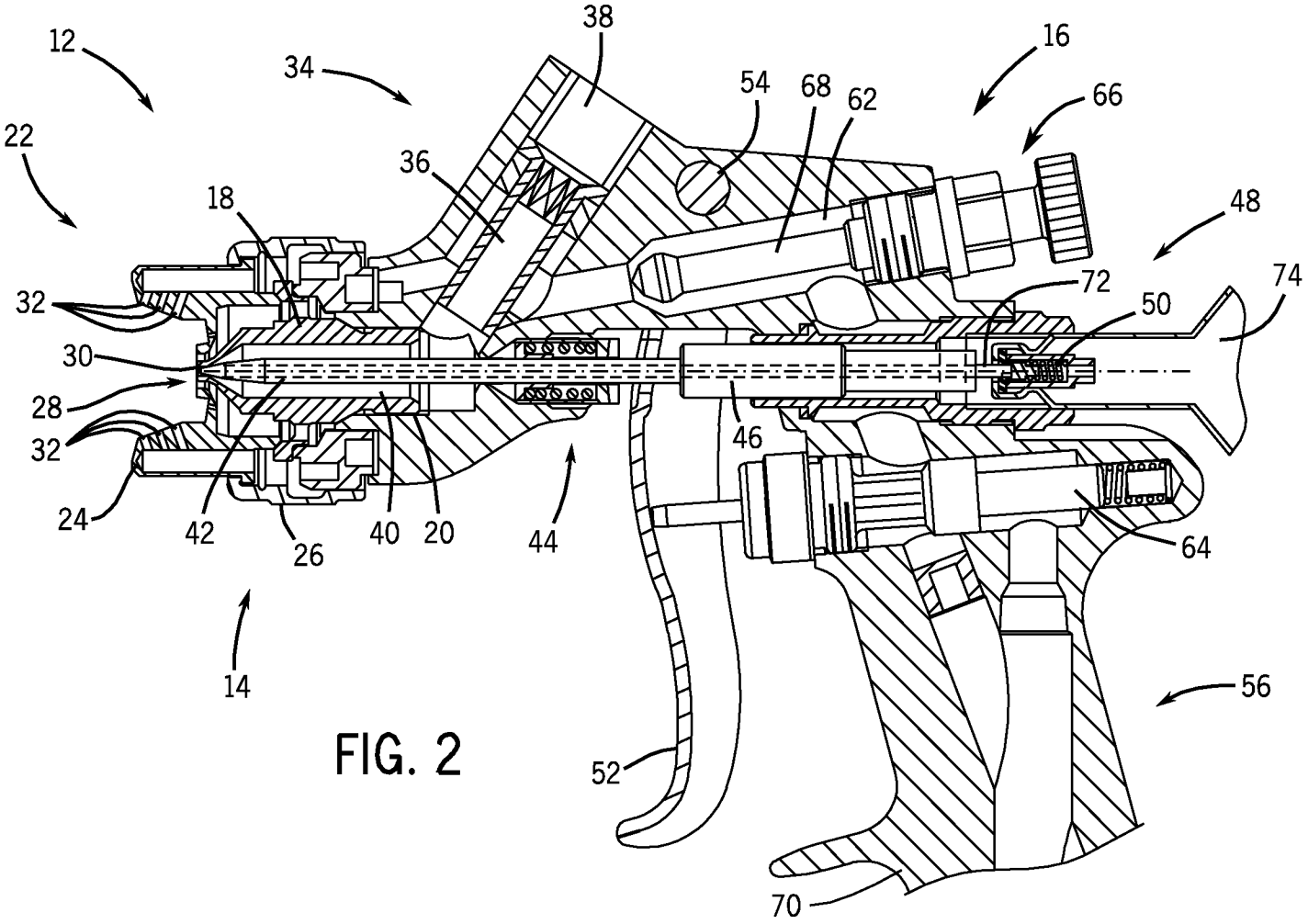

Turning now to the drawings, FIGS. 1 and 2 are cross-sectional side views of an exemplary embodiment of a spray coating gun 12 employing a needle for applying multiple component materials. As illustrated, the spray coating gun 12 includes a spray tip assembly 14 coupled to a body 16. The spray tip assembly 14 includes a fluid delivery tip assembly 18, which may be removably inserted into a receptacle 20 of the body 16. For example, a plurality of different types of spray coating devices may be configured to receive and use the fluid delivery tip assembly 18. The spray tip assembly 14 also includes a spray formation assembly 22 coupled to the fluid delivery tip assembly 18. The spray formation assembly 22 may include a variety of spray formation mechanisms, such as air, rotary, and electrostatic atomization mechanisms. However, the illustrated spray formation assembly 22 comprises an air atomization cap 24, which is removably secured to the body 16 via a retaining nut 26. The air atomization cap 24 includes a variety of air atomization orifices, such as a central atomization orifice 28 disposed about a fluid tip exit 30 from the fluid delivery tip assembly 18. The air atomization cap 24 also may have one or more spray shaping orifices 32, which force the spray to form a desired spray pattern (e.g., a flat spray). The spray formation assembly 22 also may comprise a variety of other atomization mechanisms to provide a desired spray pattern and droplet distribution.

The body 16 of the spray coating gun 12 includes a variety of controls and supply mechanisms for the spray tip assembly 14. As illustrated, the body 16 includes a first component material delivery assembly 34 having a first component material inlet passage 36 extending from a first component material inlet coupling 38 to a first component material chamber 40, which is generally defined as a passage between an inner wall of the fluid delivery tip assembly 18 and an outer surface of a multiple component delivery needle 42 of a fluid needle valve assembly 44. The first component material delivery assembly 34 may be configured to deliver a first component material into the first component material chamber 40 using gravity feed techniques, pressure feed techniques, suction feed techniques, or any other suitable method of delivery.

For example, in certain embodiments, a gravity feed reservoir may be coupled to the first component material inlet coupling 38 such that the forces of gravity cause the first component material to be delivered from the gravity feed reservoir into the first component material chamber 40. However, in other embodiments, a pressure feed reservoir may be coupled to the first component material inlet coupling 38 such that the pressure of the first component material in the pressure feed reservoir causes the first component material to be delivered from the pressure feed reservoir into the first component material chamber 40. In this embodiment, the pressure of the first component material in the pressure feed reservoir may be selectively adjusted based on operating conditions of the spray coating gun 12. For example, the pressure of the first component material may be selectively adjusted based on pressures and/or flow rates of a second component material, which may be delivered through a hollow center passage through the multiple component delivery needle 42. The selective adjustment of pressures and/or flow rates of the first and second component materials may be performed during calibration of the spray coating gun 12. In addition, in other embodiments, the first component material may be delivered from the first component material chamber 40 using suction feed techniques. In other words, the first component material may be siphoned out of the first component material chamber 40 from a low pressure area created by the pressurized flow of the second component material from the hollow center passage of the multiple component delivery needle 42.

In addition, the multiple component delivery needle 42 may be configured to at least partially control the flow rate of the first component material from the first component material chamber 40 through the fluid tip exit 30 of the fluid delivery tip assembly 18. The multiple component delivery needle 42 includes an enlarged body portion 46 extending moveably through the body 16 between the fluid delivery tip assembly 18 and a fluid valve 48. In certain embodiments, the fluid valve 48 may include a spring 50 that enables the fluid valve 48 to bias the multiple component delivery needle 42 toward the fluid delivery tip assembly 18. The enlarged body portion 46 of the multiple component delivery needle 42 is also coupled to a trigger 52, such that the enlarged body portion 46 (and the multiple component delivery needle 42) may be moved away from the fluid delivery tip assembly 18 as the trigger 52 is rotated counter clockwise about a pivot joint 54. However, any suitable inwardly or outwardly openable valve assembly may be used within the scope of the present embodiments.

An air supply assembly 56 is also disposed in the body 16 to facilitate atomization at the spray formation assembly 22. The illustrated air supply assembly 56 extends from an air inlet coupling 58 to the air atomization cap 24 via air passages 60 and 62. The air supply assembly 56 also includes a variety of seal assemblies, air valve assemblies, and air valve adjusters to maintain and regulate the air pressure and flow rate through the spray coating gun 12. For example, the illustrated air supply assembly 56 includes an air valve assembly 64 coupled to the trigger 52, such that rotation of the trigger 52 about the pivot joint 54 opens the air valve assembly 64 to allow air flow from the first air passage 60 to the second air passage 62. The air supply assembly 56 also includes an air valve adjustor 66 coupled to an air needle 68, such that the air needle 68 is movable via rotation of the air valve adjustor 66 to regulate the air flow to the air atomization cap 24. As illustrated, the trigger 52 is coupled to both the fluid needle valve assembly 44 and the air valve assembly 64, such that fluid and air simultaneously flow to the spray tip assembly 14 as the trigger 52 is pulled toward a handle 70 of the body 16. Once engaged, the spray coating gun 12 produces an atomized spray with a desired spray pattern and droplet distribution of the mixture of the first and second component materials.

More specifically, as the trigger 52 is pulled toward the handle 70 of the body 16, the multiple component delivery needle 42 is unseated from the fluid delivery tip assembly 18 and moves inwardly away from the fluid delivery tip assembly 18 such that the first component material is allowed to flow from the first component material chamber 40 through the fluid tip exit 30 of the fluid delivery tip assembly 18. At the same time, in certain embodiments, a valve end 72 of the multiple component delivery needle 42 may unseat the fluid valve 48, which may be coupled to a pressure vessel 74, allowing the second component material to flow through the hollow center of the multiple component delivery needle 42 to the atomization and mixing zone just outside the fluid tip exit 30. In this manner, the multiple component delivery needle 42 may proportionally control the flow of the first and second component materials. However, in other embodiments, the fluid valve 48 may be actuated by other components when the trigger 52 is pulled, enabling flow through the hollow center of the multiple component delivery needle 42. For example, in certain embodiments, the valve end 72 of the multiple component delivery needle 42 may include holes in its sides, such that when the holes are uncovered, the second component material flows into the hollow center passage. In addition, in other embodiments, a rotary valve may be used to enable the flow of the second component material through the hollow center passage of the multiple component delivery needle 42.

The pressure vessel 74 may be pressurized such that the flow of the second component material is pressure fed. As such, the pressure of the second component material in the pressure vessel 74 may be selectively adjusted based on operating conditions of the spray coating gun 12. For example, the pressure of the second component material may be selectively adjusted based on pressures and/or flow rates of the first component material delivered from the first component material chamber 40 around the multiple component delivery needle 42. The selective adjustment of pressures and/or flow rates of the first and second component materials may be performed during calibration of the spray coating gun 12. However, in other embodiments, the second component material may also be gravity fed, suction fed, or delivered using any suitable feeding techniques.

As described above, the second component material may flow through the center of the hollow multiple component delivery needle 42 toward the fluid tip exit 30 of the fluid delivery tip assembly 18. As such, the first and second component materials are not premixed. Rather, the first and second component materials may be delivered to the front of the spray coating gun 12, where the first and second component materials are mixed external to the spray coating gun 12 during atomization. The hollow center passage may extend axially through at least a portion of the multiple component delivery needle 42. In other words, in certain embodiment, the hollow center passage may not extend axially through the entire length of the multiple component delivery needle 42. Rather, the hollow center passage may only extend halfway though the multiple component delivery needle 42, with the second component material exiting at a different location than in the embodiment where the hollow center passage extends through the entire length of the multiple component delivery needle 42.

Figure 3:
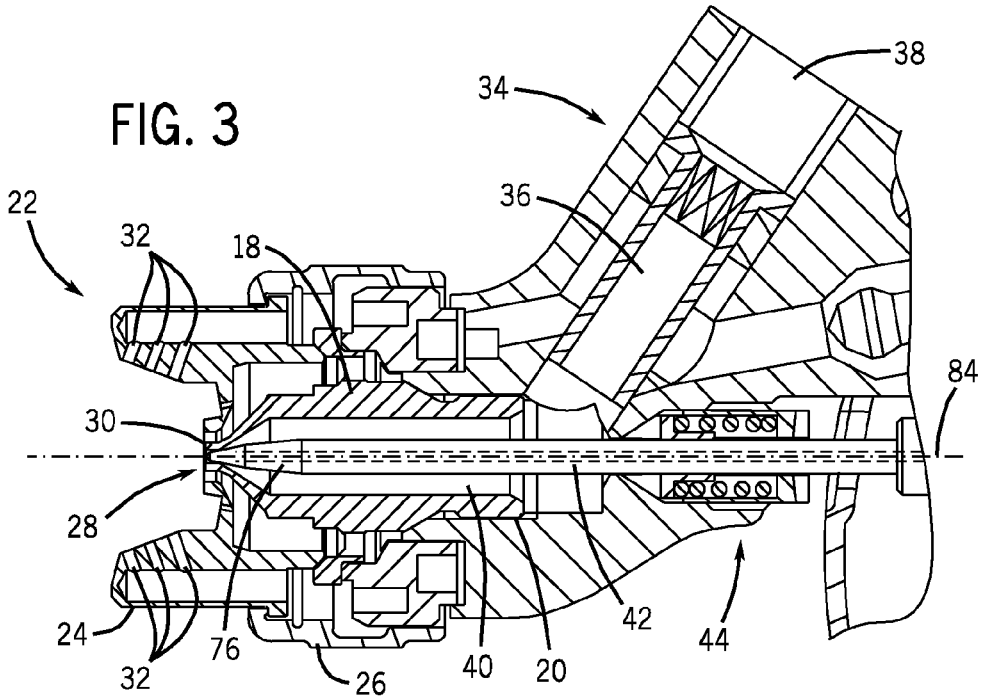
FIG. 3 is a partial cross-sectional side view of the spray coating gun of FIGS. 1 and 2 when the trigger is not pulled.
Figure 4:
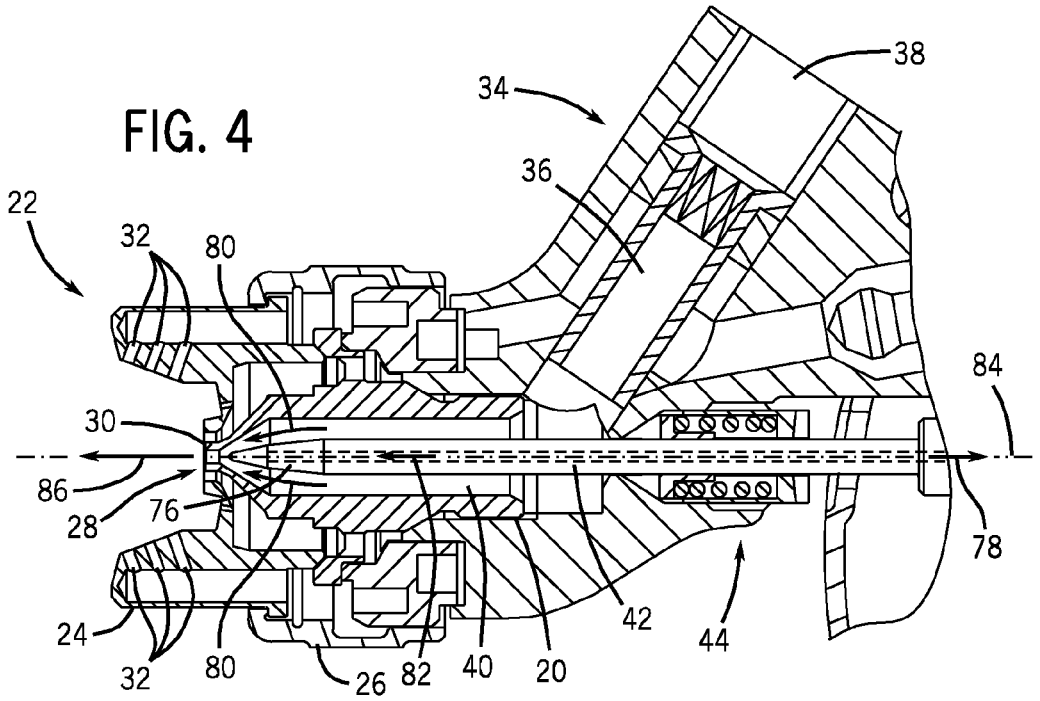
FIG. 4 is a partial cross-sectional side view of the spray coating gun of FIGS. 1 and 2 when the trigger is pulled.

FIG. 3 is a partial cross-sectional side view of the spray coating gun 12 of FIGS. 1 and 2 when the trigger 52 is not pulled. Conversely, FIG. 4 is a partial cross-sectional side view of the spray coating gun 12 of FIGS. 1 and 2 when the trigger 52 is pulled. As such, FIGS. 3 and 4 illustrate how the flow of the first and second component materials are affected by the trigger 52. As illustrated in FIG. 3, when the trigger 52 is not being pulled, a tip 76 of the multiple component delivery needle 42 abuts the fluid tip exit 30 of the fluid delivery tip assembly 18. As such, the flow of the first component material may be at least partially blocked because there is little to no space between the tip 76 of the multiple component delivery needle 42 and the fluid tip exit 30 of the fluid delivery tip assembly 18. In addition, when the trigger 52 is not being pulled, the fluid valve 48 is not unseated (e.g., by the valve end 72 of the multiple component delivery needle 42), as described above with respect to FIGS. 1 and 2. Because the fluid valve 48 is not unseated, the flow of the second component material from the pressure vessel 74 is at least partially blocked. Therefore, the flow of the second component material through the hollow center of the multiple component delivery needle 42 is generally not pressurized. As such, the flow rate of the second component material from the hollow center of the multiple component delivery needle 42 may be negligible.

However, when the trigger 52 is being pulled, the multiple component delivery needle 42 moves away from the fluid tip exit 30 of the fluid delivery tip assembly 18, as illustrated by arrow 78 in FIG. 4. As such, the first component material may be allowed to flow around the tip 76 of the multiple component delivery needle 42 through the fluid tip exit 30 of the fluid delivery tip assembly 18, as illustrated by arrows 80. In addition, when the trigger 52 is being pulled, the fluid valve 48 is unseated (e.g., by the valve end 72 of the multiple component delivery needle 42), as described above with respect to FIGS. 1 and 2. Because the fluid valve 48 is unseated, the second component material is allowed to flow from the pressure vessel 74. In addition, the flow of the second component material through the hollow center of the multiple component delivery needle 42 is pressurized. As such, the second component material will flow through the hollow center of the multiple component delivery needle 42 to the fluid tip exit 30 of the fluid delivery tip assembly 18, as illustrated by arrow 82.

Because the second component material is pressurized due to the pressure in the pressure vessel 74, the second component material may generally flow from the hollow center of the multiple component delivery needle 42 through the fluid tip exit 30 of the fluid delivery tip assembly 18 along a common axis 84 of the multiple component delivery needle 42, the fluid delivery tip assembly 18, and the air atomization cap 24, as illustrated by arrow 86. However, the manner in which the first component material flows from the first component material chamber 40 through the fluid tip exit 30 of the fluid delivery tip assembly 18 may depend on whether the first component material is gravity fed, pressure fed, or suction fed into the first component material chamber 40.

Figure 5:
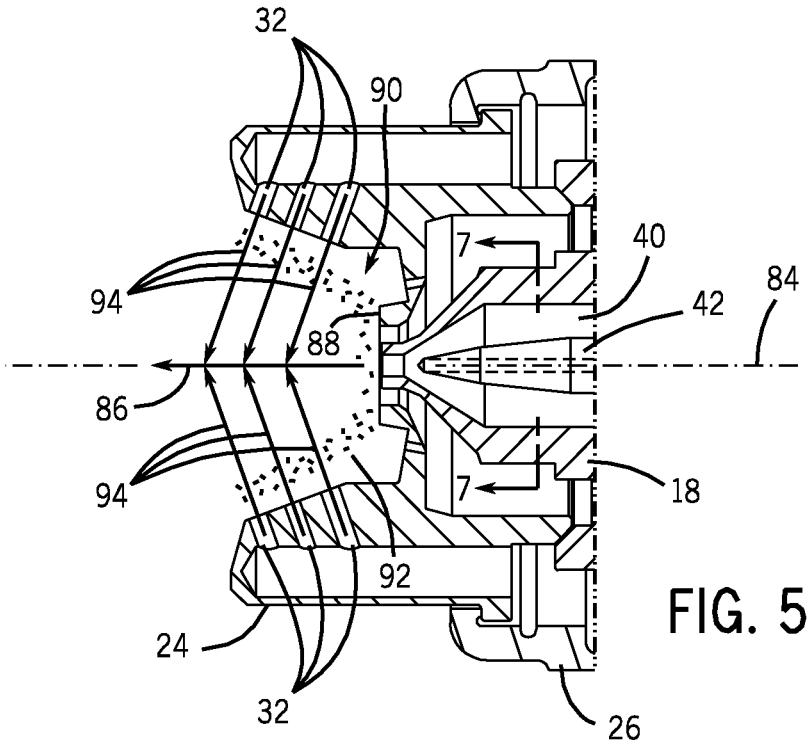
FIG. 5 is a partial cross-sectional side view of the spray coating gun of FIGS. 1 through 4, wherein the trigger is pulled and the first component material is gravity fed or suction fed.

For example, FIG. 5 is a partial cross-sectional side view of the spray coating gun 12 of FIGS. 1 through 4, wherein the trigger is pulled 52 and the first component material is gravity fed or suction fed. When the first component material is gravity fed, the pressure of the first component material within the first component material chamber 40 may be less than when the first component material is pressure fed. As such, instead of being forced through the fluid tip exit 30 of the fluid delivery tip assembly 18 by an applied pressure, the first component material may flow through the fluid tip exit 30 of the fluid delivery tip assembly 18 influenced by the forces of gravity. In addition, in certain embodiments, the first component material may be suction fed. For example, the first component material may be at least partially siphoned through the fluid tip exit 30 of the fluid delivery tip assembly 18 by a low pressure area along an exterior face 88 of the air atomization cap 24. The low pressure area is generally created by the pressurized flow of the second component material from the hollow center of the multiple component delivery needle 42. The suctioning effect may cause particles of the first component material to flow along an interior area 90 of the air atomization cap 24, as illustrated by 92, until the particles of the first component material reach the shaping air 94, which flows from the spray shaping orifices 32 of the air atomization cap 24. The shaping air 94 then directs the particles of the first component material toward the pressurized stream 86 of the second component material, where the first and second component materials may be mixed before being directed to the object being sprayed. The suctioning effect may actually exist for both a gravity fed or suction fed first component material. In fact, in certain embodiments, the suctioning effect may even impact the first component material when it is pressure fed.

Figure 6:
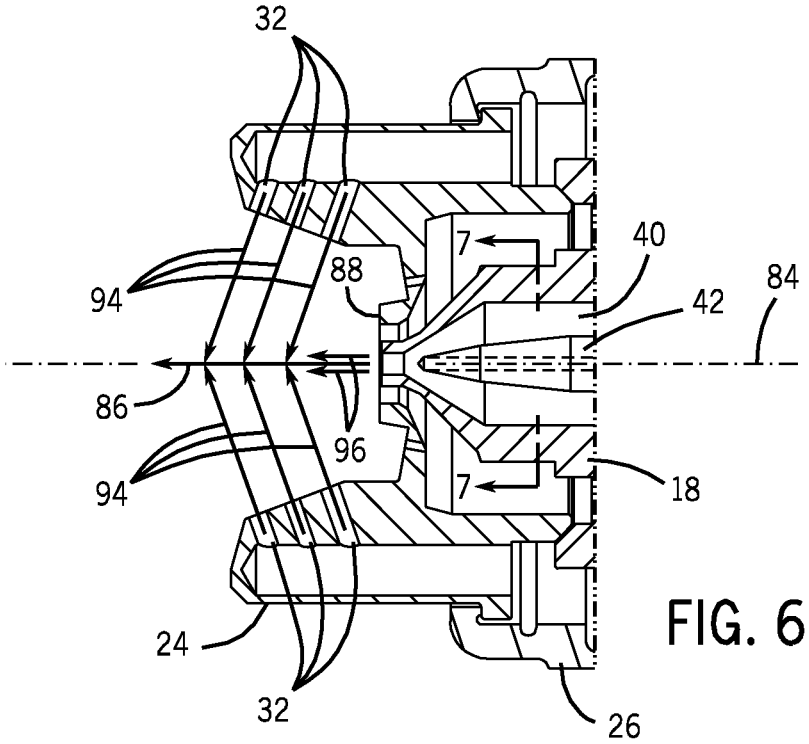
FIG. 6 is a partial cross-sectional side view of the spray coating gun of FIGS. 1 through 4, wherein the trigger is pulled and the first component material is pressure fed.

Conversely, FIG. 6 is a partial cross-sectional side view of the spray coating gun 12 of FIGS. 1 through 4, wherein the trigger is pulled 52 and the first component material is pressure fed. When the first component material is pressure fed, the pressure of the first component material within the first component material chamber 40 may be greater than when the first component material is gravity fed or suction fed. As such, the first component material may be forced through the fluid tip exit 30 of the fluid delivery tip assembly 18 by the applied pressure, as illustrated by arrows 96. Therefore, the pressurized streams 86, 96 of the first and second component materials may generally mix before, during, and after the shaping air 94 from the spray shaping orifices 32 of the air atomization cap 24.

In certain embodiments, when the multiple component delivery needle 42 is in a closed position, the tip 76 of the multiple component delivery needle 42 may extend past the front of the fluid tip exit 30. When the trigger 52 is pulled, the tip 76 of the multiple component delivery needle 42 may be approximately flush with the fluid tip exit 30. However, in other embodiments, when the multiple component delivery needle 42 is in a closed position, the tip 76 of the multiple component delivery needle 42 may be approximately flush with the fluid tip exit 30. When the trigger 52 is pulled, the tip 76 of the multiple component delivery needle 42 may be recessed inwardly within the fluid tip exit 30.

In any case (e.g., gravity feeding, suction feeding, or pressure feeding of the first component material), the first and second component materials are not premixed inside the spray coating gun 12. Rather, the first and second component materials are delivered to the front of the spray coating gun 12, where the first and second component materials are mixed external to the spray coating gun 12 during atomization. However, in other embodiments, depending on the operating parameters (e.g., flow rate and/or pressure) of the first and second component materials, a certain amount of the mixing may actually occur near to or inside of the fluid tip exit 30 of the fluid delivery tip assembly 18. For example, the first and second component materials may be mixed where the first component material chamber 40 meets the fluid tip exit 30 of the fluid delivery tip assembly 18.

Figure 7:
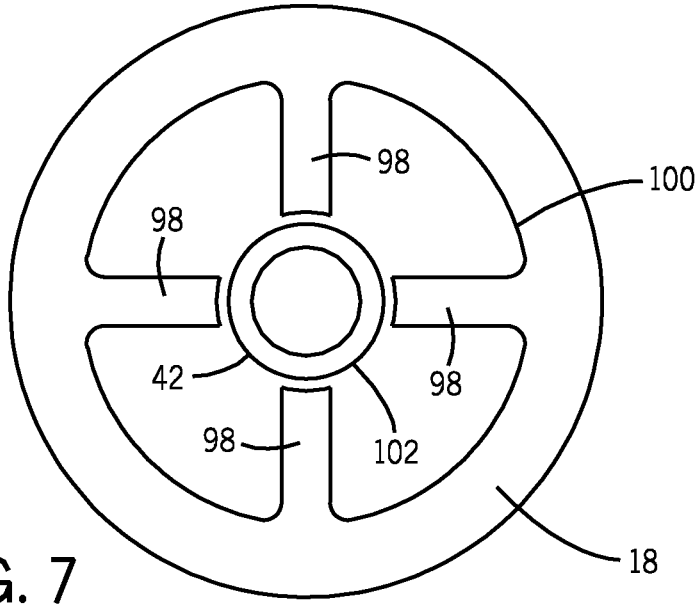
FIG. 7 is a cross-sectional axial view of the multiple component delivery needle and the fluid delivery tip assembly of the spray coating gun of FIGS. 1 through 6.

In certain embodiments, the multiple component delivery needle 42 may have guides to help maintain concentricity within the interior of the fluid delivery tip assembly 18. For example, FIG. 7 is a cross-sectional axial view of the multiple component delivery needle 42 and the fluid delivery tip assembly 18 of the spray coating gun 12 of FIGS. 1 through 6. As illustrated, the fluid delivery tip assembly 18 may include four guides 98 extending from an interior surface 100 of the fluid delivery tip assembly 18 to an exterior surface 102 of the multiple component delivery needle 42. The guides 98 ensure that the multiple component delivery needle 42 moves concentrically within the fluid delivery tip assembly 18 while also enabling the first component material to flow through the first component material chamber 40 within the fluid delivery tip assembly 18. The guides 98 illustrated in FIG. 7 are merely exemplary and not intended to be limiting. For example, in other embodiments, the multiple component delivery needle 42 may include guides that extend from the exterior surface 102 of the multiple component delivery needle 42 to the interior surface 100 of the fluid delivery tip assembly 18. In addition, any suitable number of guides may be used.

As described above, the multiple component delivery needle 42 includes a hollow center through which the second component material flows from the pressure vessel 74. In addition, as described above, the first component material flows from the first component material chamber 40 within the fluid delivery tip assembly 18 through the space between the fluid tip exit 30 of the fluid delivery tip assembly 18 and the exterior surface 102 of the multiple component delivery needle 42 when the trigger 52 is pulled. To aid the flow of the first component material through the fluid tip exit 30, in certain embodiments, the multiple component delivery needle 42 may include a plurality of openings 104 along the exterior circumferential surface 102 of the multiple component delivery needle 42.

Figure 8:
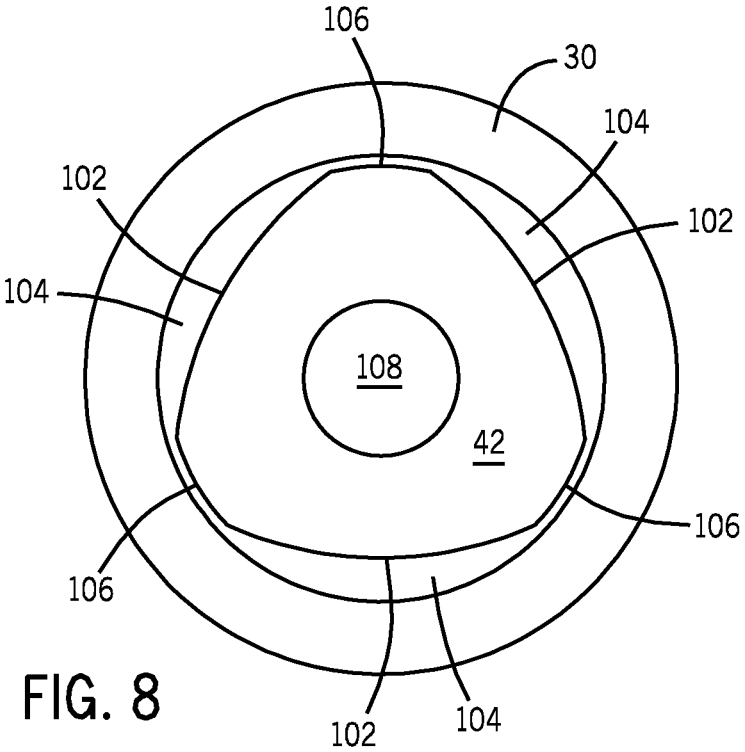
FIG. 8 is an axial view of an exemplary embodiment of the multiple component delivery needle and the fluid tip exit of the fluid delivery tip assembly.

For example, FIG. 8 is an axial view of an exemplary embodiment of the multiple component delivery needle 42 and the fluid tip exit 30 of the fluid delivery tip assembly 18. As illustrated, the multiple component delivery needle 42 includes three openings 104 along the exterior circumferential surface 102 near the tip 76 of the multiple component delivery needle 42. In other words, the exterior circumferential surface 102 of the multiple component delivery needle 42 does not completely abut the fluid tip exit 30 of the fluid delivery tip assembly 18 and enables flow of the first component material.

The openings 104 may generally be defined as indentions that extend axially along the exterior surface 102 near the tip 76 of the multiple component delivery needle 42. Any number of openings 104 may be used on the exterior circumferential surface 102 of the multiple component delivery needle 42. For example, in certain embodiments, the multiple component delivery needle 42 may include 2, 3, 4, 5, 6, or more openings 104. In addition, in the embodiment illustrated in FIG. 8, the openings 104 are formed by convex segments of the exterior circumferential surface 102 of the multiple component delivery needle 42. However, in other embodiments, the openings 104 may be formed by concave or straight-edged segments of the exterior circumferential surface 102 of the multiple component delivery needle 42. In certain embodiments, the multiple component delivery needle 42 may include edges 106 between the openings 104. The edges 106 may abut the fluid tip exit 30 of the fluid delivery tip assembly 18.

Figure 9:
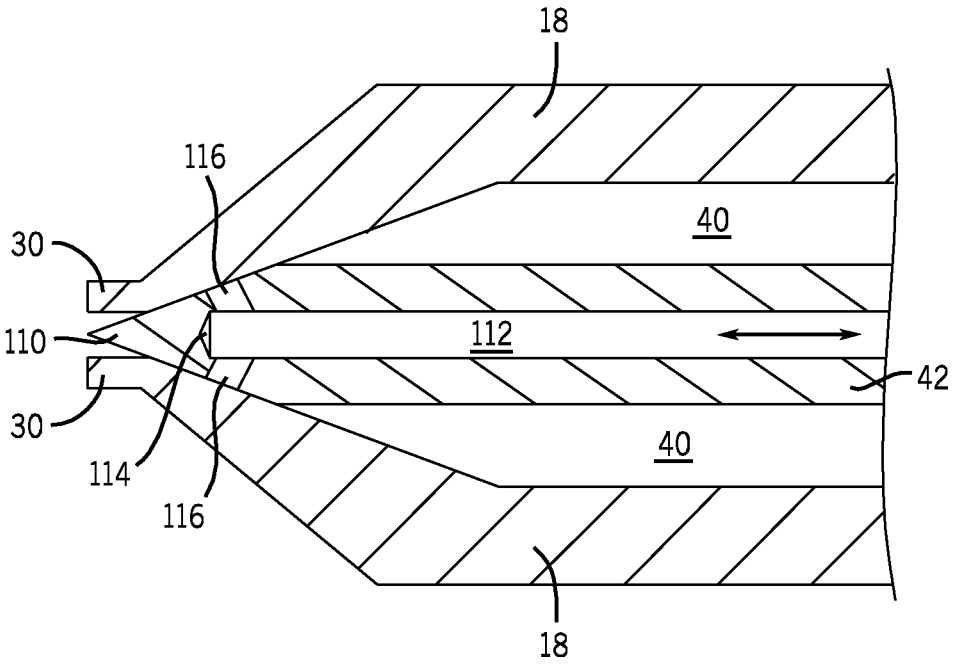
FIG. 9 is a partial cross-sectional side view of an exemplary embodiment of the multiple component delivery needle having a spray tip end that does not include an exit hole.

The multiple component delivery needle 42 of FIGS. 3 through 8 is illustrated as having a hollow center along the common axis 84 through an exit hole 108 at an end of the multiple component delivery needle 42. However, in other embodiments, the multiple component delivery needle 42 may be shaped differently at the end of the multiple component delivery needle 42 that abuts the fluid tip exit 30 of the fluid delivery tip assembly 18. For example, FIG. 9 is a partial cross-sectional side view of an exemplary embodiment of the multiple component delivery needle 42 having a spray tip end 110 that does not include the exit hole 108 at the common axis 84. Rather, the hollow center 112 of the multiple component delivery needle 42 illustrated in FIG. 9 terminates prior to the spray tip end 110 at a terminal wall 114.

Just upstream of the terminal wall 114, a plurality of exit holes 116 may be in fluid connection with the hollow center 112 of the multiple component delivery needle 42. The exit holes 116 may extend from the hollow center 112 at least partially radially and may seal against a tapper or other means within the fluid delivery tip assembly 18. In other words, when the trigger 52 is not being pulled and the multiple component delivery needle 42 abuts the fluid tip exit 30 of the fluid delivery tip assembly 18, the flow of the second component material through the hollow center 112 and the exit holes 116 of the multiple component delivery needle 42 may be impeded. However, when the trigger 52 is being pulled and the multiple component delivery needle 42 pulls away from the fluid tip exit 30 of the fluid delivery tip assembly 18, the flow of the second component material through the hollow center 112 and the exit holes 116 of the multiple component delivery needle 42 may be enabled. In this manner, the second component material may begin mixing with the first component material from the first component material chamber 40 just downstream of the exit holes 116. As such, the exit holes 116 against the fluid tip exit 30 of the fluid delivery tip assembly 18 may function as a valve, which may supplement and/or replace the functioning of the fluid valve 48 near the valve end 72 of the multiple component delivery needle 42 of FIGS. 1 and 2.

Figure 10:
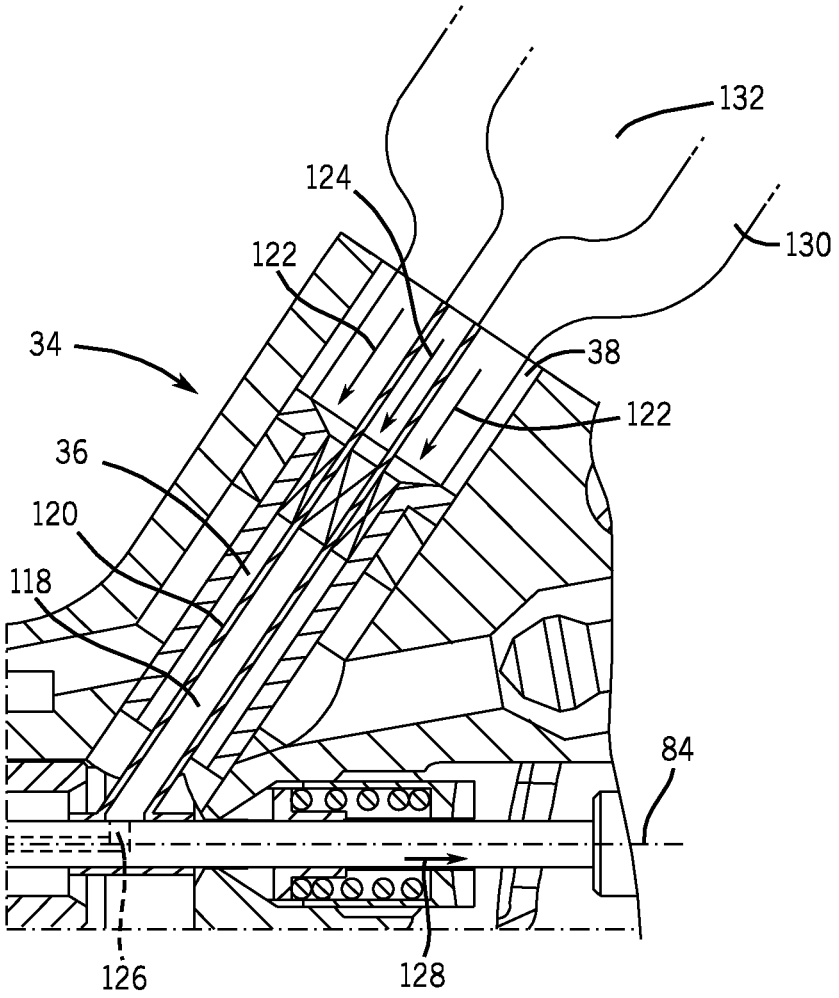
FIG. 10 is a partial cross-sectional side view of an exemplary embodiment of the spray coating gun having a second component material inlet passage coaxially through a first component material inlet passage.

In addition, in certain embodiments, the first and second component materials may be fed from generally the same inlet location. For example, in certain embodiments, the second component material may not be fed from the valve end 72 of the multiple component delivery needle 42. Rather, the second component material may be fed coaxially through the first component material inlet passage 36. More specifically, the second component material may be fed through a second component material passage, which is coaxial within the first component material inlet passage 36. FIG. 10 is a partial cross-sectional side view of an exemplary embodiment of the spray coating gun 12 having a second component material inlet passage 118 coaxially through the first component material inlet passage 36. As illustrated, a second component material tube 120 may be located within the first component material inlet passage 36 such that the second component material inlet passage 118 is coaxial within the first component material inlet passage 36.

The first component material may still be fed into the first component material chamber 40 through the first component material inlet passage 36, as illustrated by arrows 122. However, as illustrated by arrow 124, the second component material may be fed through the second component material tube 120, which defines the second component material inlet passage 118 within the first component material passage 36. Therefore, the hollow center 112 of the multiple component delivery needle 42 may only extend through the multiple component delivery needle 42 from the tip 76 of the multiple component delivery needle 42 to approximately where the second component material inlet passage 118 fluidly connects to the multiple component delivery needle 42.

The second component material may be fed into the hollow center 112 of the multiple component delivery needle 42 through cross holes 126 in the multiple component delivery needle 42. The cross holes 126 may extend from the hollow center 112 of the multiple component delivery needle 42 to the exterior circumferential surface 102 of the multiple component delivery needle 42. In certain embodiments, the cross holes 126 may not be in fluid connection with the second component material inlet passage 118 when the trigger 52 is not being pulled. However, the cross holes 126 may be brought into fluid connection with the second component material inlet passage 118 when the trigger 52 is pulled and the multiple component delivery needle 42 moves away from the fluid tip exit 30 of the fluid delivery tip assembly 18, as illustrated by arrow 128. In certain embodiments, the first and second component materials may be fed through a cup-within-a-cup design, wherein the first component material is fed through a first cup 130 that is located around a second cup 132, which is used to feed the second component material.

In certain embodiments, the first component material may comprise paint, whereas the second component material may comprise an activator (e.g., thinner). However, in other embodiments, different liquids may be used as the component materials with the disclosed embodiments. In other words, the multiple component delivery needle 42 and associated components of the spray coating gun 12 may have applications with various types of plural component materials, and are not limited to paints and activators. In addition, although the disclosed embodiments disclose the use of two component materials, in other embodiments, more than two component materials may be used. For example, in certain embodiments, the hollow center passage within the multiple component delivery needle 42 may actually include two independent half-circle flow paths, or two parallel circular or non circular flow paths. As such, more than one component material may flow through the hollow center passage of the multiple component delivery needle 42. In this embodiment, the multiple component delivery needle 42 may be coupled to a single fluid valve or more than one fluid valve to deliver the multiple component materials through the multiple hollow passages within the multiple component delivery needle 42.

The embodiments described herein enable the delivery of the first component material between the fluid tip exit 30 of the fluid delivery tip assembly 18 and the exterior surface 102 of the multiple component delivery needle 42 while enabling the delivery of the second component material from the hollow center of the multiple component delivery needle 42. As described above, the delivery of the first and second component materials may be synchronized such that the first and second component materials mix in an appropriate ratio. By not premixing the first and second component materials, excess waste material created by the painter may be minimized because the painter only uses as much of the first and second component materials as needed. Further, because mixing of the first and second component materials generally occurs in front of the fluid tip exit 30 of the fluid delivery tip assembly 18, the disclosed embodiments may reduce cleanup time as well as provide the painter with more time before having to clean the components of the spray coating gun 12. As such, the disclosed embodiments provide a user friendly, compact way of spraying multiple component materials.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a fluid delivery tip assembly, comprising:

an interior surface of the fluid delivery tip assembly, wherein the interior surface defines an inner passage;

a spray gun needle having a hollow passage extending axially through the spray gun needle, and at least two indentions along an outer circumferential surface of the spray gun needle near a tip of the spray gun needle, wherein the spray gun needle is disposed coaxially within the inner passage; and one or more guides between the interior surface and the spray gun needle, wherein the one or more guides are configured to ensure that the spray gun needle moves coaxially within the inner passage.

2. The system of claim 1, wherein the indentions comprise convex indentions.

3. The system of claim 1, wherein the indentions comprise concave indentions.

4. The system of claim 1, wherein the spray gun needle is coupled to a fluid valve configured to deliver a spray material into the hollow passage of the spray gun needle.

5. The system of claim 1, comprising a fluid delivery tip assembly, wherein the spray gun needle is disposed coaxially within an inner passage of the fluid delivery tip assembly.

6. The system of claim 5, wherein the indentions enable flow of a spray material between the spray gun needle and a fluid tip exit of the fluid delivery tip assembly.

7. The system of claim 1, wherein the spray gun needle is configured to proportionally control a first flow of a first spray material and a second flow of a second spray material through a spray coating gun, wherein the first flow is configured to flow around the outer circumferential surface of the spray gun needle, and the second flow is configured to flow through the hollow passage of the spray gun needle.

8. The system of claim 7, comprising a pressurized canister coupled to the hollow passage of the spray gun needle.

9. The system of claim 7, wherein the first flow of the first spray material is delivered using gravity feeding.

10. The system of claim 1, wherein the one or more guides extend from the outer circumferential surface of the spray gun needle.

11. A method, comprising:

delivering a first spray fluid to a fluid tip exit of a fluid delivery tip assembly between the fluid delivery tip assembly and a needle disposed coaxially within an inner passage of the fluid delivery tip assembly, wherein the needle comprises at least two indentions along an outer circumferential surface of the needle near an end of the needle, one or more guides are disposed between the inner passage of the fluid delivery tip assembly and the outer circumferential surface of the needle, and the one or more guides are configured to ensure that the needle is coaxially disposed within the inner passage; and delivering a second spray fluid to the fluid tip exit of the fluid delivery tip assembly through a hollow passage extending axially through the needle.

12. The method of claim 11, comprising moving the needle axially away from the fluid tip exit of the fluid delivery tip assembly, enabling the first spray fluid to flow between the fluid delivery tip assembly and the needle.

13. The method of claim 12, wherein moving the needle axially away from the fluid tip exit is configured to proportionally control the delivery of the first spray fluid and the second spray fluid.

14. The method of claim 11, comprising delivering paint to the fluid tip exit of the fluid delivery tip assembly between the fluid delivery tip assembly and the needle.

15. The method of claim 11, comprising delivering an activator to the fluid tip exit of the fluid delivery tip assembly through the hollow passage extending axially through the needle.

16. A spray coating gun, comprising:

a spray gun needle comprising a first hollow passage extending axially through the spray gun needle and a second hollow passage extending axially through the spray gun needle;

a fluid delivery tip assembly, wherein the spray gun needle is disposed coaxially within an inner passage of the fluid delivery tip assembly of the spray coating gun; and one or more guides between an interior surface of the inner passage and the spray gun needle, wherein the one or more guides are configured to ensure that the spray gun needle moves coaxially within the inner passage.

17. The spray coating gun of claim 16, wherein the spray gun needle is coupled to one or more fluid valves configured to deliver a first spray material into the first hollow passage of the spray gun needle, and to deliver a second spray material into the second hollow passage of the spray gun needle.

18. The spray coating gun of claim 16, wherein the fluid delivery tip assembly is configured to deliver a third spray material through the inner passage of the fluid delivery tip assembly.

19. The spray coating gun of claim 16, wherein the spray gun needle comprises at least two indentions along an outer circumferential surface of the spray gun needle near an end of the spray gun needle.

* * * * *